US009581924B2

(12) United States Patent
Veregin et al.

(10) Patent No.: US 9,581,924 B2
(45) Date of Patent: Feb. 28, 2017

(54) BIO-BASED ACRYLATE AND (METH)ACRYLATE RESINS

(71) Applicant: Xerox Corporation, Norwalk, CT (US)

(72) Inventors: Richard P N Veregin, Mississauga (CA); Guerino G Sacripante, Oakville (CA)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/541,509

(22) Filed: Nov. 14, 2014

(65) Prior Publication Data

US 2016/0139526 A1 May 19, 2016

(51) Int. Cl.
*G03G 9/113* (2006.01)
*G03G 9/08* (2006.01)

(52) U.S. Cl.
CPC ..... *G03G 9/1133* (2013.01); *G03G 9/0825* (2013.01)

(58) Field of Classification Search
CPC ..... G03G 9/1132; G03G 9/1135
See application file for complete search history.

(56) References Cited

U.S. PATENT DOCUMENTS 6,130,018 A * 10/2000 Kawata ..... G03G 9/10 399/350
6,165,663 A * 12/2000 Baba ..... G03G 9/0821 430/111.3
2003/0212296 A1* 11/2003 Frings ..... C08F 2/60 562/601
2008/0038654 A1* 2/2008 Yamazaki ..... G03G 9/08704 430/110.3
2009/0018300 A1* 1/2009 Bloom ..... C08G 61/12 527/102
2014/0200288 A1* 7/2014 Jin ..... C07D 493/04 523/116

FOREIGN PATENT DOCUMENTS

JP 2012246351 * 12/2012 ..... C09D 133/14

OTHER PUBLICATIONS

The Condensed Chemical Dictionary, Tenth Edition, Revised by Gessner G. Hawley, Van Nostrand Reinhold Company; 10th Revised edition (Apr. 1981), p. 585.
"Acryloyl Group," as seen on Wikipedia, the free online encyclopedia, which can be found on the World Wide Web at https://en.wikipedia.org/wiki/Acryloyl_group, accessed Sep. 1, 2016, 1 page.

* cited by examiner

*Primary Examiner* — Hoa V Le
(74) *Attorney, Agent, or Firm* — Marylou J. Lavoie, Esq. LLC

(57) ABSTRACT

(Meth)acrylate resins of at least one bio-based (meth)acrylate monomer, where the monomer includes a rosin or isosorbide moiety obtained from natural sources, can be used in toner, carrier coating or both.

4 Claims, No Drawings

BIO-BASED ACRYLATE AND (METH)ACRYLATE RESINS

FIELD

The disclosure relates generally to a bio-based acrylate and (meth)acrylate resins comprising isosorbide acrylate/(meth)acrylate or rosin acrylate/(meth)acrylate.

BACKGROUND

Most polyester-based resins are prepared from monomers obtained from petroleum or are man-made materials, ("conventional monomers"). With an increased focus on impact on environment and health, there is an interest and/or a need to find suitable replacements to reduce health risk and negative environmental impact associated with carrier and toner production and use.

Bio-based monomers in polymeric materials reduce dependency on fossil fuels and render the polymeric materials more sustainable. Recently, the USDA proposed that all toner/ink have a bio content of at least 10%.

Toner resins using bio-based monomers were described, see, for example, U.S. Pat. No. 8,580,472. Nevertheless, there remains a need to use same successfully and to increase the bio-content of toner, and to incorporate bio-content into carriers, the other element of two-component developers comprising toner particles and carriers, while maintaining or improving favorable toner, carrier and developer properties.

A bio-based resin, including those with a high C/O ratio, which can be formulated into a toner particle or to coat a carrier, is described.

SUMMARY

The instant disclosure describes bio-based resins for use in toner xerographic applications. The resins can be used in the core, shell or both of a toner particle. The resins can be used as a coating of a carrier. The resin of interest comprises a bio-based polyacrylate or poly(meth)acrylate.

In embodiments, a resin is described comprising at least one bio-based acrylate or (meth)acrylate monomer wherein the bio-based acrylate or (meth)acrylate monomer comprises a rosin or isosorbide moiety, and optionally, another monomer, such as, an acrylic monomer, a methacrylic monomer, a styrene monomer and so on.

The rosin or isosorbide moieties, obtained from natural sources, optionally are reacted with a reagent to generate the at least one bio-based monomer. The monomers are polymerized, as a homopolymer (100% bio-based), or with other monomer(s) to generate copolymers. The resins, alone or in combination with polymers or copolymers, are used in toner, or are coated on a carrier core to generate a carrier composition.

In embodiments, a composition is described comprising a bio-based polyacrylate or poly(meth)acrylate carrier coating composition, wherein the polyacrylate or poly(meth)acrylate comprises; i) at least one bio-based acrylate or (meth) acrylate monomer, wherein the bio-based acrylate or methacrylate monomer comprises a rosin or isosorbide moiety and a monomer; and, ii) a least one comonomer selected from methylmethacrylate, cyclohexylmethacrylate, cyclopropyl acrylate cyclobutyl acrylate, cyclopentyl acrylate, cyclohexyl acrylate, cyclopropyl methacrylate, cyclobutyl methacrylate, cyclopentyl methacrylate, isobornyl methacrylate, isobornyl acrylate, butyl acrylate, hexyl acrylate, ethylhexylacrylate, butyl methacrylacrylate, hexyl methacrylate, ethylhexyl methacrylate, acrylic acid, methacrylic acid, β-carboxyethyl acrylate, dimethylamino ethyl methacrylate, 2-(dimethylamino)ethyl methacrylate, diethylamino ethyl methacrylate, dimethylamino butyl methacrylate, methylamino ethyl methacrylate, styrene and combinations thereof.

In embodiments, a composition is described comprising a bio-based polyacrylate or poly(meth)acrylate toner composition, wherein the polyacrylate or poly(meth)acrylate comprises; i) at least one bio-based acrylate or (meth)acrylate monomer, wherein the bio-based acrylate or methacrylate monomer comprises a rosin or isosorbide moiety and a monomer; and, ii) a least one comonomer selected from methyl acrylates, ethyl acrylates, butyl acrylates, isobutyl acrylates, dodecyl acrylates, n-octyl acrylates, 2-chloroethyl acrylates; β-carboxy ethyl acrylate (β-CEA), phenyl acrylates, methyl α-chloroacrylates, methyl methacrylates (MMA), ethyl methacrylates, butyl methacrylates; butadienes; isoprenes; methacrylonitriles; acrylonitriles; vinyl ethers, such as, vinyl methyl ether, vinyl isobutyl ether, vinyl ethyl ether and the like; vinyl esters, such as, vinyl acetate, vinyl propionate, vinyl benzoate and vinyl butyrate; vinyl ketones, such as, vinyl methyl ketone, vinyl hexyl ketone and methyl isopropenyl ketone; vinylidene halides, such as, vinylidene chloride and vinylidene chlorofluoride; N-vinyl indoles; N-vinyl pyrrolidones; methacrylates (MA); acrylic acid; methacrylic acids; acrylamides; methacrylamides; vinylpyridines; vinylpyrrolidones; vinyl-N-methylpyridinium chloride; vinyl naphthalenes; p-chlorostyrenes; vinyl chlorides; vinyl bromides; vinyl fluorides; ethylenes; propylenes; butylenes; isobutylenes; and the like, and mixtures thereof.

In embodiments, a developer is disclosed including a toner particle and a coated carrier, wherein one or more of toner core, toner shell and carrier coating comprise a polyacrylate or poly(meth)acrylate comprising at least one bio-based acrylate or (meth)acrylate monomer wherein the bio-based acrylate or (meth)acrylate monomer comprises a rosin or isosorbide moiety.

DETAILED DESCRIPTION

Introduction

The present disclosure provides sustainable resins for toner and/or carrier. In particular, provided herein are polyacrylate or poly(meth)acrylate sustainable resins.

Acrylate and methacrylate resins, also referred to herein interchangeably and collectively as, "(meth)acrylate," resins or polymers, comprise desirable properties suitable for toner and/or carrier core coatings. Some of those properties include, but are not limited to, enhanced positive charge for carrier applications, which may be tuned, for example, with the addition of certain moieties or monomers (e.g. dimethylaminoethyl methacrylate), and enhanced negative charge for toner applications, which may be tuned with the addition of certain moieties or monomers (e.g. acrylic acid). Other properties include, but are not limited to, enhanced carrier coating robustness which can be obtained, for example, by using higher molecular weight resins (which can be achieved by, for example, emulsion polymerization); and enhanced toner image gloss by a lower toner molecular weight resin (which can be achieved by, for example, addition of chain transfer agents in an emulsion polymerization.) Using a higher carbon/oxygen ratio (C/O) for toner and/or carrier coating (which is preferred for desired low RH sensitivity) can enhance carrier resin and toner resin properties. In embodiments, the overall positive charge resides on the carrier and the toner has the overall negative charge.

In embodiments, the polyacrylate or poly(meth)acrylate sustainable resins comprise at least one bio-based monomer. Those monomers may replace all or part of conventional monomers used to synthesize polyacrylate or poly(meth) acrylate resins resulting in resins with up to 100%, by weight of the polymer, bio-based monomers, but which may be as low as at least about 10% bio-based monomers, at least about 20% by weight of bio-based monomers. As used herein, "conventional monomers," refer to those monomers obtained from petroleum or man-made materials (e.g. using fossil fuels) that do not comprise at least one bio-based moiety. In contrast, the present bio-based monomers are derived from or otherwise are sourced from a natural source (e.g. plants, algae, protozoa, animals, microbes and so on), which comprise at least one bio-based moiety.

The present bio-based monomers are synthesized utilizing a bio-based moiety comprising a hydroxyl group (—OH) or a carboxylic acid group (—COOH) that is reacted with an acrylic or methacrylic monomer to generate a bio-based acrylate or (meth)acrylate monomer. Any bio-based monomer comprising a hydroxyl group or carboxylic acid group can be used to synthesize the present bio-based acrylate or (meth)acrylate monomers. Acrylic or methacrylic monomers include, but are not limited to, acryloyl chloride, methacryloyl chloride, epoxy acrylate, epoxy methacrylate and so on.

In embodiments, the bio-based moiety is isosorbide, which may be used to synthesize acrylate or diacrylate monomers (see Examples 1 and 3) or methacrylate or dimethacrylate monomers (see Examples 2 and 3) by reacting with an acrylic or methacrylic monomer, for example, acryloyl chloride or (meth)acryloyl chloride.

In embodiments, the bio-based moiety is a rosin, which may be used to synthesize methacrylated or dimethacrylated rosin (see Example 6) by reacting with an acrylic or methacrylic monomer, for example, glycidyl methacrylate. The rosin bio-based moiety can be, for example, abietic acid, hydrogenated abietic acid or disproportionated abietic acid.

The polymeric latexes may be synthesized using methods known in the art to form resin polymers, including bulk polymerization, solution polymerization and emulsion polymerization. In embodiments, only bio-based acrylate or (meth)acrylate monomers are used in the polymerization reaction to prepare the polyacrylate or poly(meth)acrylate resins. In embodiments, the bio-based acrylate or (meth) acrylate monomers are co-polymerized with conventional monomers (e.g. those that do not comprise at least one bio-based moiety) including acrylates and methacrylates to prepare the acrylate or poly(meth)acrylate resins. In embodiments, the bio-based acrylate or (meth)acrylate monomers can be copolymerized with a charge control agent, such as, a methacrylic acid or a dimethylaminoethyl methacrylate, and, for example, a styrene, which monomers can be used to control, for example, the Tg and hydrophobicity of the polymeric resin.

Comonomers for making carrier coating resins include, but are not limited to, methylmethacrylate, cyclohexylmethacrylate, cyclopropyl acrylate, cyclobutyl acrylate, cyclopentyl acrylate, cyclohexyl acrylate, cyclopropyl methacrylate, cyclobutyl methacrylate, cyclopentyl methacrylate, isobornyl methacrylate, isobornyl acrylate, butyl acrylate, hexyl acrylate, ethylhexyl acrylate, butyl methacrylacrylate, hexyl methacrylate, ethylhexyl methacrylate, acrylic acid, methacrylic acid, beta-carboxyethyl acrylate, dimethylamino ethyl methacrylate, 2-(dimethylamino)ethyl methacrylate, diethylamino ethyl methacrylate, dimethylamino butyl methacrylate, methylamino ethyl methacrylate, styrene and combinations thereof. In embodiments, comonomers are selected from methyl methacrylate, cyclohexyl methacrylate, styrene, methacrylic acid, dimethylaminoethyl methacrylate and combinations thereof.

Comonomers for making toner resins include, but are not limited to polyesters, styrenes, alkyl acrylates, such as, methyl acrylate, ethyl acrylate, butyl acrylate, isobutyl acrylate, dodecyl acrylate, n-octyl acrylate, 2-chloroethyl acrylate and the like; β-CEA, phenyl acrylates, methyl α-chloroacrylate, MMA's, ethyl methacrylates, butyl methacrylates; butadienes; isoprenes; methacrylonitriles; acrylonitriles; vinyl ethers, such as, vinyl methyl ether, vinyl isobutyl ether, vinyl ethyl ether and the like; vinyl esters, such as, vinyl acetate, vinyl propionate, vinyl benzoate and vinyl butyrate; vinyl ketones, such as, vinyl methyl ketone, vinyl hexyl ketone and methyl isopropenyl ketone; vinylidene halides, such as, vinylidene chloride and vinylidene chlorofluoride; N-vinyl indoles; pyrrolidones; MA's; acrylic acids; methacrylic acids; acrylamides; methacrylamides; vinylpyridines; vinylpyrrolidones; vinyl-N-methylpyridinium chlorides; vinyl naphthalenes; p-chlorostyrenes; vinyl chlorides; vinyl bromides; vinyl fluorides; ethylenes; propylenes; butylenes; isobutylenes and the like, and mixtures thereof.

In embodiments, comonomers that may be used are compatible with isosorbide diacrylate, dimethacrylate, acrylate or methacrylate monomers or a rosin-based acrylate or (meth)acrylate monomer for polymerization.

In embodiments, isosorbide diacrylate, dimethacrylate, acrylate or methacrylate monomers are polymerized to form isosorbide acrylate or (meth)acrylate polymeric resins (see Example 4). In aspects, isosorbide diacrylate or dimethacrylate monomers are used to create cross-linking or branching. In embodiments, acrylated or methacrylated rosin monomers are polymerized to prepare acrylated or methacrylated rosin polymeric resins (see Example 7).

In embodiments, the polymeric resins are dried (e.g. to form to powder). For example, the resin can be combined with a conductive molecule, such as, a colorant, such as, a carbon black, wherein the powder coats the carrier core particle (see Examples 5 and 8). In embodiments, the polymeric resins are solution coated on carrier core particles with a solvent. Alternatively, the dried or hydrated resin can be combined with reagents, such as, other resins, colorants, surfactants, waxes and so on to form toner.

The bio-based polyacrylate or poly(meth)acrylate sustainable resins, comprising up to 100% bio-based monomers, up to about 50%, up to about 25%, at least about 10% bio-based monomers, may be used alone or in combination with resins comprising conventional, or non-bio based, monomers, or other bio-based monomers to form a coating on the carrier core particle or toner. In embodiments, the copolymers include cyclohexyl methacrylate (CHMA) or polymethyl methacrylate (PMMA). The present bio-based poly(meth) acrylate sustainable resins may be used to replace some or all of the conventional polymeric resins (e.g. comprising CHMA or, for example, PMMA) thereby increasing the bio-content of the resulting carrier. The bio-based polyacrylate or poly(meth)acrylate sustainable resins of interest also may be used to replace some or all of the conventional polymeric resins (e.g. styrene/butyl acrylate) thereby increasing the bio-content of the resulting toner, carrier coating and developer.

In embodiments, the isosorbide or rosin polyacrylate or poly(meth)acrylate resin comprises up to 100% bio-based monomers, up to about 50%, up to about 25%, at least about 10% bio-based monomers. In aspects, the isosorbide or rosin acrylate or poly(meth)acrylate resin comprises about 100% bio-based monomers. In aspects, the isosorbide or rosin polyacrylate or poly(meth)acrylate resin comprises from about 10% to about 75% of bio-based monomers. In aspects, the isosorbide or rosin polyacrylate or poly(meth)acrylate resin comprises from about 15% to about 70%, from about 20% to about 65%, from about 25% to about 60%, or from about 30% to about 55% bio-based monomers by weight of the resin.

Polymeric resins that do not comprise at least one bio-based monomer, also referred to herein as, "conventional," can be used in combination with the bio-based polyacrylate or poly(meth)acrylate resins described above to form a carrier coating or toner. The combination of bio-based polyacrylate or poly(meth)acrylate resins, based on the percentage by weight of the carrier coating resin or toner, can be at least about 10%, wherein the remaining about 90% may comprise (non)bio-based or conventional resins, also referred to herein as a, "copolymer," (although amounts outside of those ranges can be practiced) used in carrier coatings or toner, which are described in detail herein.

DEFINITIONS

As used herein, the modifier, "about," used in connection with a quantity is inclusive of the stated value and has the meaning dictated by the context (for example, it includes at least the degree of error associated with the measurement of the particular quantity). In embodiments, the terms of interest comprise a variation of less than about 10% from the stated value. When used in the context of a range, the modifier, "about," should also be considered as disclosing the range defined by the absolute values of the two end-points. For example, the range. "from about 2 to about 4," also discloses the range, "from 2 to 4."

As used herein, "bio-based moiety," refers to a moiety obtained from renewable resources such as plants, microbes or animals and excludes moieties obtained from non-renewable resources, such as, petroleum. As used herein, "bio-based," monomer, polymer or coating refers to those monomers, polymers or coating compositions that are obtained or prepared from, in whole or part, renewable resources, such as, plants, microbes or animals. The synthesized or prepared polymer, toner or coating compositions, etc., are composed, in whole or in part (e.g., between about 50% to about 100% by weight, from about 75% to about 100% by weight, from about 90% to about 100% by weight), of bio-based monomers or polymers.

It is understood that bio-based materials are sustainable and renewable as well as replacements and substitutes for, "conventional," materials (e.g. petroleum-based chemicals) that may not only be more cost-advantaged, but potentially reduce greenhouse gas emissions. Bio-based materials may be biodegradable.

As used herein, "biodegradable," generally relates to susceptibility of a compound or material to alteration by microbial action or to inherent lability under normal ambient conditions which limits environmental presence or persistence. Bio-based compounds generally are biodegradable. Environmental persistence may be measured as the time necessary for a certain degree of degradation or change from the original state, such as, about 50% degradation, about 40% degradation, about 30% degradation, or more or less over a period of a day, a week, a month or a minimal number of years, such as, about two years, about three years and so on.

The, "C/O," ratio of a compound or at the surface of a toner or a carrier is, at the molecular level, the relative amounts of carbon atoms and oxygen atoms of a compound or at the toner or coated carrier surface. In multimolecular structures, the C/O ratio can be ascertained if the molecular formula is known. For molecular complexes, such as, a carrier coating or a toner, the C/O ratio can be approximated by an analysis of components and the relative amounts thereof in the coating or toner. The C/O ratio of the surface of the toner or carrier can be determined, for example, by, X-ray photon spectroscopy (XPS) using, for example, devices available from Physical Electronics, MN, Applied Rigaku Technologies, TX, Kratos Analytical, UK and so on. A suitable C/O ratio is at least about 2.5, at least about 2.6, at least about 2.7, or more.

As used herein, a "rosin," or, "rosin moiety," is intended to encompass a rosin, a rosin acid, a rosin ester and so on, as well as a rosin derivative which is a rosin that is treated, for example, disproportionated or hydrogenated. As known in the art, rosin is a blend of at least eight monocarboxylic acids (abietic acid, palustric acid, dehydoabietic acid, neo-abietic acid, levo-pimaric acid, pimaric acid, sandaracopimaric acid and isopimaric acid). Abietic acid can be a primary species and the other seven acids are isomers thereof. Because of the composition of a rosin, often the synonym, "rosin acid." is used to describe various rosin-derived products. A rosin moiety includes, as known in the art, chemically modified rosin, such as, partially or fully hydrogenated rosin acids, partially or fully dimerized rosin acids, esterified rosin acids, functionalized rosin acids, disproportionated or combinations thereof. Rosin is available commercially in a number of forms, for example, as a rosin acid, as a rosin ester and so on. For example, rosin acids, rosin ester and dimerized rosin are available from Eastman Chemicals under the product lines, Poly-Pale™, Dymerex™, Staybelite-E™, Foral™ Ax-F, Lewisol™ and Pentalyn™, Arizona Chemicals under the product lines, Sylvalite™ and Sylvatac™; and Arakawa-USA under the product lines, Pensel and Hypal. Disproportionated rosins are available commercially, for example, KR-614 and Rondis™ available from Arakawa-USA, and hydrogenated rosin is available commercially, for example, Fond AX™ available from Pinova Chemicals.

Herein, a polymer or copolymer can be identified or named by one or more of the reactant monomers that comprise the polymer or copolymer, even though polymerized, the residue in the polymer no longer is identical to the monomer reagent contributing that residue. For example, if a polyester is composed of, as the polyacid component, trimellitic acid, that polymer can be identified or named as a trimellitic polyester polymer.

Bio-Based Monomers

In embodiments, the at least one bio-based monomer comprises an isosorbide moiety obtained from a natural source, such as, corn. Isosorbide is acrylated or methacrylated by reacting an acrylic or methacrylic monomer, for example, by treating with acryloyl chloride, in the presence of base. Acrylic or methacrylic monomers include, but are not limited to, acryloyl chloride (2-propenoyl chloride) or methacryloyl chloride (2-methylprop-2-enoyl chloride).

Due to the V-shaped conformation (two fused tetrahydrofuran rings) of isosorbide, the two —OH groups are located in different molecular environments (endo and exo) and have different reactivity. Depending on the reaction conditions, either the endo-OH or the exo-OH group can be functionalized. That can be useful when either a mono-acrylated or a di-acrylated (or mono-methacrylated or di-methacrylated) species is desired.

For polymerization, only one of the hydroxyl groups (—OH) can be reacted with an acrylic or methacrylic monomer to prepare a bio-based monomer. The isosorbide bio-based monomer comprises a single activated double bond for polymerization. The other —OH group optionally may be reacted with a moiety that does not have an activated double bond, for example, trimethyl acetyl chloride.

Isosorbide and isosorbide diacrylate reaction and resulting monomer can be as follows:

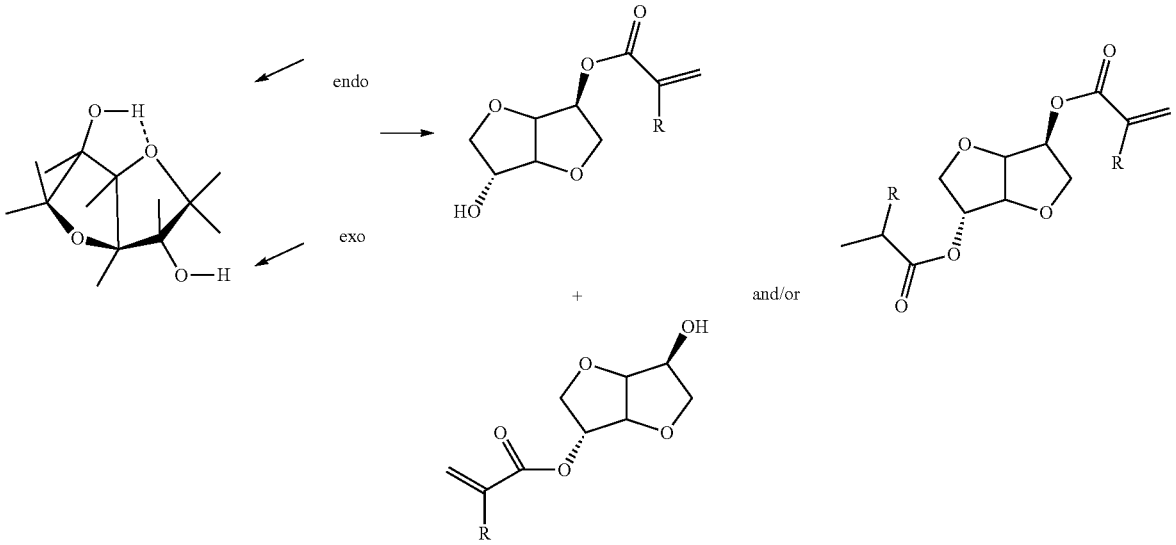

In embodiments, the at least one bio-based acrylate or methacrylate monomer is selected from the group consisting of isosorbide diacrylate, isosorbide acrylate, isosorbide methacrylate and isosorbide dimethacrylate.

In embodiments, the at least one bio-based monomer comprises a rosin moiety obtained from a natural source. In embodiments, the rosin is selected from gum rosin, wood rosin or tall-oil rosin. Rosin generally comprises mixtures of organic acids, such as, abietic acid and related compounds and isomers, including (but not limited to) neoabietic acid, palustric acid, pimaric acid, levo-pimaric acid, isopimaric acid, dehydroabietic acid, sandaracopimaric acid and the like.

The rosin acids can be modified chemically, for example, by disproportionation to result in, for example, dehydroabietic acid, or to form hydrogenated rosin acids.

The bio-based rosin moieties can be reacted with acrylic or methacrylic monomers (such as, an epoxy compound) comprising a monofunctional active double bond to provide monomers useful for making polyacrylate or poly(meth) acrylate resins suitable for use in toner and carrier coating. Acrylic or methacrylic monomers include, but are not limited to, epoxy acrylate or epoxy methacrylate. In embodiments, the acrylic or methacrylic monomer is glycidyl methacrylate.

For example, as rosin acid can react with an acrylic or methacrylic monomer, glycidyl methacrylate, where R is a methyl group, or glycidyl acrylate, where R is an H group, to generate an acrylated or (meth)acrylated rosin as follows,

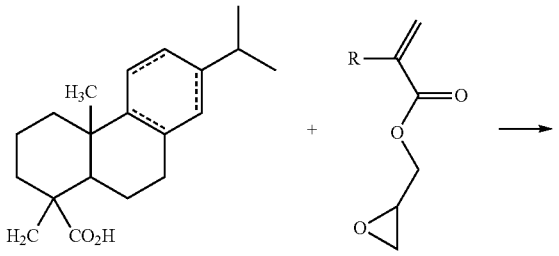

-continued

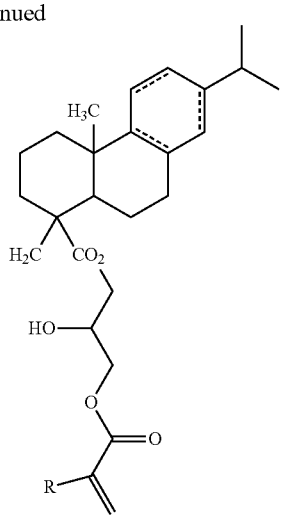

In embodiments, a bio-based monomer is abietic-(meth) acrylate.

In general, a rosin acid can be reacted with an organic bis-epoxide, which during a ring-opening reaction of the epoxy group, combines at the carboxylic acid group of a rosin acid to form a joined molecule, a bis-rosin ester. Such a reaction is compatible with the one-pot reaction conditions disclosed herein for producing a bio-based resin. A catalyst can be included in the reaction mixture to form the rosin ester. Suitable catalysts include tetra-alkyl ammonium halides, such as, tetraethyl ammonium bromide, tetraethyl ammonium iodide and tetraethyl ammonium chloride, tetra-alkyl phosphonium halides and so on. The reaction can be conducted under anaerobic conditions, for example, under a nitrogen atmosphere. The reaction can be conducted at an elevated temperature, such as, from about 100° C. to about 200° C., from about 105° C. to about 175° C., from about 110° C. to about 170° C. and so on, although temperatures outside of those ranges can be used as a design choice.

Carrier Compositions a) Carrier Coating Resins

The resin of interest can be used as a carrier coating. The resin can comprise up to 100% of bio-based monomers, not less than 50% bio-based monomers, at least about 10% bio-based monomers by weight of the resin.

In embodiments, the carrier coating comprises up to about 50%, up to about 40%, up to about 30%, up to about 20%, up to about 10%, by weight of the carrier coating of conventional resins that do not comprise bio-based monomers. In aspects, the carrier coating comprises from about 1% to about 50%, from about 1% to about 40%, from about 1% to about 30%, from about 1% to about 20%, from about 1% to about 10% or from about 1% to about 5%, by weight of the carrier coating, of conventional carrier coating resins that do not comprise bio-based monomers It is understood that the present bio-based polyacrylate or poly(meth)acrylate polymers may be present in the carrier coating up to 100%, by weight of the carrier coating, or in combination with the conventional resins that do not comprise bio-based resins, wherein the combination increases the bio-content of the carrier coating but still provides comparable or improved properties as compared to carrier coating with predominantly, and up to 100%, conventional resins that do not comprise bio-based resins. In that regard, the carrier coating can comprise about 1% to about 100%, by weight of the carrier coating, of bio-based polyacrylate or poly(meth)acrylate resins. The carrier coating also can comprise, in combination with the bio-based polyacrylate or poly(meth)acrylate resins, about 0% to about 99%, by weight of the carrier coating, conventional resins that do not comprise bio-based monomers. In embodiments, the bio-based polyacrylate or poly(meth)acrylate resins are used to replace a portion or percentage of the conventional resins used in a carrier coating.

In embodiments, the conventional latex polymers utilized in combination with the bio-based poly(meth)acrylate resins as the coating of a carrier core may include at least one acrylate, optionally, an acidic acrylate monomer, and optionally, a conductive material, such as, a colorant, such as, a carbon black. Suitable cycloacrylates for forming the polymer coating include, for example, cyclohexylmethacrylate (CHMA or PCHMA for polyCHMA), cyclopropyl acrylate, cyclobutyl acrylate, cyclopentyl acrylate, cyclohexyl acrylate, cyclopropyl methacrylate, cyclobutyl methacrylate, cyclopentyl methacrylate, isobornyl methacrylate, isobornyl acrylate and the like, and combinations thereof.

In embodiments, a coating may include a copolymer of cyclohexylmethacrylate with isobornyl methacrylate, with the cyclohexylmethacrylate present in an amount of from about 0.1% to about 99.9% by weight of the copolymer, from about 35% to about 65% by weight of the copolymer, with the isobornyl methacrylate present in an amount from about 99.9% to about 0.1% by weight of the copolymer, from about 65% to about 35% by weight of the copolymer.

Charge control agents include, but are not limited to, acidic acrylates and dialkylaminoacrylates. Suitable acidic acrylate monomers include, for example, acrylic acid, methacrylic acid, β-CEA, combinations thereof and the like. Suitable dialkylaminoacrylates which may be utilized in forming the polymer coating include, for example, dimethylamino ethyl methacrylate (DMAEMA), 2-(dimethylamino)ethyl methacrylate, diethylamino ethyl methacrylate, dimethylamino butyl methacrylate, methylamino ethyl methacrylate, combinations thereof and the like.

By negative additives that are negatively chargeable to a reference carrier is meant that the additives are negatively charging relative to the toner surface measured by determining the toner triboelectric charge with and without the additives. Similarly, by positive additives that are positively chargeable to a carrier is meant that the additives are positively charging relative to the toner surface measured by determining the toner triboelectric charge with and without the additives.

Where the cycloacrylate is combined with a charge control monomer, the cycloacrylate may be present in an amount of from about 0.1% by weight of the copolymer to about 99.8% by weight of the copolymer, from about 50% by weight of the copolymer to about 95% by weight of the copolymer. The charge control monomer may be present in such a copolymer in an amount of from about 0.1% by weight of the copolymer to about 5% by weight of the copolymer.

Resins with high C/O ratios (e.g., containing CHMA) improve RH, sensitivity while providing good charge, as compared to, for example, PMMA resins.

Methods for forming the polymer are within the purview of those skilled in the art and include, emulsion polymerization of the monomers utilized to form the polymer as taught herein.

In a polymerization process, the reactants may be added to a suitable reactor, such as, a mixing vessel. The appropriate amount of starting materials, optionally dissolved in a solvent, is combined with an optional initiator and optionally, with at least one surfactant, to form an emulsion. A polymer may be formed in the emulsion, which then may be recovered and used as the polymer.

Where utilized, suitable solvents include, but are not limited to, water and/or organic solvents, including, toluene, benzene, xylene, tetrahydrofuran, acetone, acetonitrile, carbon tetrachloride, chlorobenzene, cyclohexane, diethyl ether, dimethyl ether, dimethyl formamide, heptane, hexane, methylene chloride, pentane, methyl ethyl ketone, isopropanol, combinations thereof and the like.

In embodiments, the latex for forming the polymeric coating may be prepared in an aqueous phase containing a surfactant or co-surfactant, optionally under an inert gas, such as, nitrogen. Surfactants which may be utilized with the resin to form a latex dispersion can be ionic or nonionic surfactants as taught herein, in an amount of from about 0.01 to about 15 wt % of the solids, from about 0.1 to about 10 wt % of the solids.

In embodiments, an initiator may be added for forming a latex. Examples of suitable initiators include water soluble initiators, such as, ammonium persulfate, sodium persulfate and potassium persulfate, and organic soluble initiators including organic peroxides and azo compounds including Vazo peroxides, such as VAZO 64™, 2-methyl 2-2'-azobis propanenitrile, VAZO 88™, 2-2'-azobis isobutyramide dehydrate and combinations thereof. Initiators can be added in amounts from about 0.1 to about 8 wt %, from about 0.2 to about 5 wt % of the monomers.

In forming the emulsions, the starting materials, optional surfactant, optional solvent and optional initiator may be combined utilizing any means within the purview of those skilled in the art. In embodiments, the reaction mixture may be mixed for from about 1 min to about 72 hrs, from about 4 hrs to about 24 hrs (although times outside those ranges may be utilized), while keeping the temperature at from about 10° C. to about 100° C., from about 20° C. to about 90° C., from about 45° C. to about 75° C. although temperatures outside those ranges may be utilized.

Those skilled in the art will recognize that optimization of reaction conditions, temperature, initiator loading and so on can be varied to generate resins of various molecular weight, and structurally related starting materials may be polymerized using comparable techniques.

Once the polymer has formed, the resin may be recovered from the emulsion by any technique within the purview of those skilled in the art, including filtration, drying, centrifugation, spray drying, combinations thereof and the like.

b) Carrier Particles

Various suitable solid core or particle materials can be utilized for the carriers and developers of the present disclosure. Characteristic particle properties include those that, in embodiments, will enable the toner particles to acquire a positive charge or a negative charge, and carrier cores that provide desirable flow properties in the developer reservoir present in an electrophotographic imaging apparatus. Other desirable properties of the core include, for example, suitable magnetic characteristics that permit magnetic brush formation in magnetic brush development processes; desirable mechanical aging characteristics; and desirable surface morphology to permit high electrical conductivity of any developer including the carrier and a suitable toner.

Examples of carrier particles or cores that can be utilized include iron and/or steel, such as, atomized iron or steel powders available from, for example, Hoeganaes Corp. (SW) or Pomaton S.p.A (IT); ferrites, such as, Cu/Zn-ferrite containing, for example, about 11% copper oxide, about 19% zinc oxide, about 70% iron oxide, including those commercially available from D. M. Steward Corp, or Powdertech Corp., Ni/Zn-ferrite available from Powdertech Corp., Sr (strontium)-ferrite, containing, for example, about 14% strontium oxide and about 86% iron oxide, commercially available from Powdertech Corp., and Ba-ferrite; magnetites, including those commercially available from, for example, Hoeganaes Corp.; nickel; combinations thereof, and the like. Other suitable carrier cores are illustrated in, for example, U.S. Pat. Nos. 4,937,166, 4,935,326 and 7,014,971, the entire disclosure of each of which hereby is incorporated by reference in entirety, and may include granular zircon, granular silicon, glass, silicon dioxide, combinations thereof and the like. In embodiments, suitable carrier cores may have an average particle size of, for example, from about 60 μm to about 100 μm in diameter, from about 40 μm to about 400 μm in diameter, from about 20 μm to about 500 μm in diameter.

Other metals may be utilized as the core including copper, zinc, nickel, manganese, magnesium, calcium, lithium, strontium, zirconium, titanium, tantalum, bismuth, sodium, potassium, rubidium, cesium, strontium, barium, yttrium, lanthanum, hafnium, vanadium, niobium, aluminum, gallium, silicon, germanium, antimony, combinations thereof and the like.

c) Preparation of Carrier Compositions

Resins are applied to carrier cores using any method known in the art, including for example, mixing cores in a solution comprising a resin or with a powdered resin.

Once obtained, the resins utilized as the coating for a carrier may be dried to a powder form by any method within the purview of those skilled in the art, including, for example, freeze drying, spray drying, combinations thereof and the like.

Particles of resin may have a size of from about 40 μm to about 500 nm, from about 50 nm to about 400 nm, from about 60 nm to about 300 nm, from about 20 nm to about 250 nm, from about 30 nm to about 225 nm, from about 40 nm to about 200 nm, from about 45 nm to about 175 nm.

In embodiments, if the size of the panicles of the dried polymeric coating is too large, the particles may be subjected to mechanical treatment, for example, grinding or sonication, to disperse further the particles, to reduce the size of particles or to break apart any agglomerates or loosely bound particles, thereby obtaining resin particles, such as, primary particles, of the sizes noted above.

The resins utilized as the carrier coating may have an Mn of from about 60,000 to about 400,000, from about 170,000 to about 280,000, and an Mw of from about 200,000 to about 800,000, from about 400,000 to about 600,000.

The resins utilized as the carrier coating may have a $T_g$ of from about 85° C. to about 140° C. from about 100° C. to about 130° C.

There may be added to the carrier a number of additives, for example, charge enhancing additives, including particulate amine resins, such as, melamine, alkyl-amino acrylates and methacrylates, polyamides and fluorinated polymers, such as, polyvinylidine fluoride and poly(tetrafluoroethylene) and fluoroalkyl methacrylates, such as, 2,2,2-trifluoroethyl methacrylate. Other charge enhancing additives which may be utilized include quaternary ammonium salts, including distearyl dimethyl ammonium methyl sulfate (DDAMS), bis[1-[(3,5-disubstituted-2-hydroxyphenyl)azo]-3-(monosubstituted)-2-naphthalenolato(2-)]chromate(1-), cetyl pyridinium chloride (CPC), FANAL PINK® D4830, combinations thereof and the like, and other effective known charge agents or additives. Examples of a conductive component include colorants, such as, carbon blacks. The charge additive components may be selected in various effective amounts, such as, from about 0.5 wt % to about 20 wt %, from about 1 wt % to about 3 wt %, based, for example, on the sum of the weights of polymer/copolymer, conductive component and other charge additive components.

Addition of conductive components can act to increase further the negative triboelectric charge imparted to the carrier, and therefore, further increase the negative triboelectric charge imparted to the toner in, for example, an electrophotographic development subsystem. The components may be included by roll mixing, tumbling, milling, shaking, electrostatic powder cloud spraying, use of a fluidized bed, electrostatic disc processing and use of an electrostatic curtain, as described, for example, in U.S. Pat. No. 6,042,981, the entire disclosure of which hereby is incorporated by reference in entirety, and wherein the carrier coating is fused to the carrier core in either a rotary kiln or by passing through a heated extruder apparatus.

Conductivity can be important for semiconductive magnetic brush development to enable good development of solid areas which otherwise may be developed weakly. Addition of a polymeric coating of the present disclosure, optionally with a conductive component, such as, a colorant, such as, a carbon black, can result in carriers with decreased developer triboelectric response with change in relative humidity of from about 20% to about 90%, from about 40% to about 80%, that is, the charge is more consistent when the relative humidity changes. Thus, there is less decrease in charge at high relative humidity thereby reducing background toner on the prints, and less increase in charge and subsequently less loss of development at low relative humidity, resulting in improved, image quality performance due to improved optical density.

Solution coating may require a polymer whose composition and molecular weight properties enable the resin to be soluble in a solvent in the coating process. That may require relatively low Mw resins. The powder coating process does not require solvent solubility and hence, larger polymers or higher molecular weight polymers can be used. The dried resin particles can be from about 10 nm to about 2 μm, from about 30 nm to about 1 μm, from about 50 nm to about 500 nm in size.

Examples of processes for applying the powder coating include, for example, combining the carrier core material and coating powder by cascade roll mixing, including extrusion, tumbling, including a rotary kiln, milling, shaking, electrostatic powder cloud spraying, use of a fluidized bed, electrostatic disc processing, use of electrostatic curtains, combinations thereof and the like. When resin-coated carrier particles are prepared by a powder coating process, the majority of the coating materials may be fused to the carrier surface, thereby reducing the number of toner impaction sites on the carrier. Fusing of the polymeric coating may occur by mechanical impaction, electrostatic attraction, heat application, combinations thereof and the like.

Heating may be initiated to permit flow of the coating material over the surface of the carrier core. The concentration of the coating material, in embodiments, powder particles, and the parameters of the heating may be selected, to enable the formation of a continuous film of the coating polymer(s) on the surface of the carrier core, or to permit only selected areas of the carrier core to be coated. In embodiments, the carrier with the polymeric powder coating may be heated to a temperature of from about 170° C. to about 280° C., from about 190° C. to about 240° C., for a period of from about 10 min to about 180 min, from about 15 min to about 60 min, to enable the polymer coating to melt and to fuse to the carrier core particles. The powder may be fused to the carrier core in either a rotary kiln or by passing through a heated extruder apparatus, see, for example, U.S. Pat. No. 6,355,391, the entire disclosure of which hereby is incorporated by reference in entirety.

The coating coverage encompasses from about 10% to about 100% of the surface area of the carrier core. When selected areas of a carrier core remain uncoated or exposed, the carrier particles may possess electrically conductive properties, such as, when the core material is a metal.

The coated carrier particles then may be cooled, in embodiments, to room temperature (RT), and recovered for use in forming developer.

In embodiments, carriers of the present disclosure may include a core, in embodiments, a ferrite core, having a size of from about 20 to about 100 μm, from about 30 μm to about 75 μm, coated with from about 0.5% to about 10% by weight, from about 0.7% to about 5% by weight, from about 1% to about 4% of a polymer coating of the present disclosure, optionally including a conductive material, such as, a colorant, such as, a carbon black.

Thus, with the carrier compositions of the present disclosure, there can be formulated bio-based developers with selected high triboelectric charging characteristics and/or conductivity values and/or improved RH sensitivity.

To measure carrier conductivity or resistivity, about 30 to about 50 g of the carrier may be placed between two circular planar parallel steel electrodes (radius of about 3 cm) and compressed by a weight of 4 kg to form an about 0.4 to about 0.5 cm layer; a DC voltage of about 10 V may be applied between the electrodes, and a DC current may be measured in series between the electrodes and voltage source after 1 min following the moment of voltage application. Conductivity in $(\text{ohm cm})^{-1}$ may be obtained by multiplying current in amps by the layer thickness in centimeters and dividing by the electrode area in $cm^2$ and by the voltage, 10 V. Resistivity may be obtained as the inverse of conductivity and may be measured in ohm-cm. The voltage may be increased to 150 V and the measurement repeated using the value of the voltage of 150 V in the equations.

In accordance with the present disclosure, a carrier may have a resistivity of from about $10^9$ to about $10^{14}$ ohm-cm measured at 10 V, from about $10^8$ to about $10^{13}$ ohm-cm at 150 V.

Developer charging and RH sensitivity can be improved by increasing the molar C/O ratio of the carrier coating resin. Thus, developers of the present disclosure may have an RH sensitivity of from about 0.4 to about 1.0, from about 0.6 to about 0.8.

Developers

In embodiments, developers comprise a toner particle and a present resin or a resin of interest comprises a carrier coating. The toner concentration in the developer may be from about 1% to about 25% by weight of the total weight of the developer, from about 2% to about 15% by weight of the total weight of the developer.

Any known type of image development system may be used in an image developing device, including, for example, magnetic brush development, hybrid scavengeless development (HSD) and the like. Those and similar development systems are within the purview of those skilled in the art.

It is envisioned, that the developers of the present disclosure may be used in any suitable procedure for forming an image with a toner, including in applications other than xerographic applications.

In embodiments, the developer of the present disclosure may be used for a xerographic print protective composition that provides overprint coating properties including, but not limited to, thermal and light stability and smear resistance, particularly in commercial print applications. An overprint coating as envisioned permits overwriting, reduces or prevents thermal cracking, improves fusing, reduces or prevents document offset, improves print performance and protects an image from sun, heat and the like. In embodiments, the overprint compositions may be used to improve the overall appearance of xerographic prints by filling the roughness of xerographic substrates and toners, thereby forming a level film and enhancing glossiness.

Toner Particles

The resins may be used in any toner panicle known in the art to formulate a present developer for imaging purposes. In embodiments, the toner particle is an emulsion aggregation toner. The various components and materials of emulsion aggregation toners are provided below along with the process for preparing such toners.

a) Polymer

The latex resin may be composed of a first and a second monomer composition. Any suitable monomer or mixture of monomers may be selected to prepare the first monomer composition and the second monomer composition. The selection of monomer or mixture of monomers for the first monomer composition is independent of that for the second monomer composition and vice versa. A first or a second monomer can be a bio-based monomer, such as, an isosorbide or rosin acrylate or methacrylate monomer as taught herein. The second monomer represents one or more monomers.

Exemplary monomers for the first and/or the second monomer compositions include, but are not limited to, polyesters, styrenes, alkyl acrylates, such as, methyl acrylate, ethyl acrylate, butyl acrylate, isobutyl acrylate, dodecyl acrylate, n-octyl acrylate, and 2-chloroethyl acrylate; β-CEA, phenyl acrylates, methyl α-chloroacrylates, alkyl methacrylates, such as, MMA, ethyl methacrylate and butyl methacrylate; butadienes; isoprenes; methacrylonitriles;

acrylonitriles; vinyl ethers, such as vinyl methyl ether, vinyl isobutyl ether, vinyl ethyl ether and the like; vinyl esters, such as, vinyl acetate, vinyl propionate, vinyl benzoate and vinyl butyrate; vinyl ketones, such as, vinyl methyl ketone, vinyl hexyl ketone and methyl isopropenyl ketone; vinylidene halides, such as, vinylidene chloride and vinylidene chlorofluoride; N-vinyl indoles; N-vinyl pyrrolidones MA; acrylic acid; methacrylic acids; acrylamides; methacrylamides; vinylpyridines; vinylpyrrolidones; vinyl-N-methylpyridinium chloride; vinyl naphthalenes; p-chlorostyrene; vinyl chlorides; vinyl bromides; vinyl fluorides; ethylenes; propylenes; butylenes; isobutylene; and the like, and mixtures thereof. In case a mixture of monomers is used, the latex polymer can be a copolymer.

In embodiments, the first monomer composition and the second monomer composition independently of each other may comprise two, three or more different monomers. The latex polymer therefore can comprise a copolymer. Illustrative examples of such a latex copolymer includes poly (styrene-n-butyl acrylate-β-CEA), poly(styrene-alkyl acrylate), poly(styrene-1,3-diene), poly(styrene-alkyl methacrylate), poly(alkyl methacrylate-alkyl acrylate), poly (alkyl methacrylate-aryl acrylate), poly(aryl methacrylate-alkyl acrylate), poly(alkyl methacrylate), poly(styrene-alkyl acrylate-acrylonitrile), poly(styrene-1,3-diene-acrylonitrile), poly(alkyl acrylate-acrylonitrile), poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly (butyl acrylate-butadiene), poly(styrene-isoprene), poly (methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly(styrene-butyl acrylate), poly(styrene-butadiene-acrylonitrile), poly(styrene-butyl acrylate-acrylonitrile), poly(rosin acrylate-n-butyl acrylate-β-CEA), poly(rosin acrylate-alkyl acrylate), poly(rosin acrylate-1,3-diene), poly(rosin acrylate-alkyl methacrylate), poly(rosin acrylate-alkyl acrylate-acrylonitrile), poly(rosin acrylate-1,3-diene-acrylonitrile), poly(rosin acrylate-butadiene), poly(rosin acrylate-styrene-butadiene), poly(rosin acrylate-isoprene), poly(rosin acrylate-propyl acrylate), poly(rosin acrylate-butyl acrylate), poly (rosin acrylate-butadiene-acrylonitrile), poly(rosin acrylate-butyl acrylate-acrylonitrile), poly(rosin acrylate-styrene-n-butyl acrylate-β-CEA), poly(rosin acrylate-styrene-alkyl acrylate), poly(rosin acrylate-styrene-1,3-diene), poly(rosin acrylate-styrene-alkyl methacrylate), poly(rosin acrylate-alkyl methacrylate-alkyl acrylate), poly(rosin acrylate-alkyl methacrylate-aryl acrylate), poly(rosin acrylate-aryl methacrylate-alkylacrylate), poly(s rosin acrylate-styrene-alkyl acrylate-acrylonitrile), poly(rosin acrylate-styrene-1,3-diene-acrylonitrile), poly(rosin acrylate-alkyl acrylate-acrylonitrile), poly(rosin acrylate-styrene-butadiene), poly(rosin acrylate-methylstyrene-butadiene), poly(rosin acrylate-methyl methacrylate-butadiene), poly(rosin acrylate-ethyl methacrylate-butadiene), poly(rosin acrylate-propyl methacrylate-butadiene), poly(rosin acrylate-butyl methacrylate-butadiene), poly(rosin acrylate-methyl acrylate-butadiene), poly(rosin acrylate-ethyl acrylate-butadiene), poly(rosin acrylate-propyl acrylate-butadiene), poly(rosin acrylate-butyl acrylate-butadiene), poly(rosin acrylate-styrene-isoprene), poly(rosin acrylate-methylstyrene-isoprene), poly (rosin acrylate-methyl methacrylate-isoprene), poly(rosin acrylate-ethyl methacrylate-isoprene), poly(rosin acrylate-propyl methacrylate-isoprene), poly(rosin acrylate-butyl methacrylate-isoprene), poly(rosin acrylate-methyl acrylate-isoprene), poly(rosin acrylate-ethyl acrylate-isoprene), poly (rosin acrylate-propyl acrylate-isoprene), poly(rosin acrylate-butyl acrylate-isoprene); poly(rosin acrylate-styrene-propyl acrylate), poly(rosin acrylate-styrene-butyl acrylate), poly(rosin acrylate-styrene-butadiene-acrylonitrile), poly (rosin acrylate-styrene-butyl acrylate-acrylonitrile) and the like. In the copolymers above, isosorbide can substitute for rosin, and methacrylate can substitute for acrylate, including with isosorbide, the monomers include diacrylate and dimethacrylate.

The first monomer composition and the second monomer composition may be substantially water insoluble, such as, hydrophobic, and may be dispersed in an aqueous phase with adequate stirring when added to a reaction vessel, optionally, when mixed with as miscible organic solvent, a surfactant and so on.

The weight ratio between the first monomer composition and the second monomer composition may be in the range of from about 0.1:99.9 to about 10:90, from about 0.5:99.5 to about 25:75, from about 1:99 to about 50:50.

The first monomer composition and the second monomer composition can be the same. Examples of the first/second monomer composition may be a mixture comprising styrene and alkyl acrylate, such as, a mixture comprising styrene, n-butyl acrylate and β-CEA. Based on total weight of the monomers, styrene may be present in an amount from about 1% to about 99%, from about 50% to about 95%, from about 70% to about 90%, although may be present in greater or lesser amounts; alkyl acrylate, such as, n-butyl acrylate, may be present in an amount from about 1% to about 99%, from about 5% to about 50%, from about 10% to about 30%, although may be present in greater or lesser amounts.

The resins may be as polyester resin, such as, an amorphous resin, a crystalline resin and/or a combination thereof, including the resins described in U.S. Pat. Nos. 6,593,049 and 6,756,176, the entire disclosure of each of which hereby is incorporated by reference in entirety. Suitable resins may also include a mixture of an amorphous polyester resin and a crystalline polyester resin as described in U.S. Pat. No. 6,830,860, the entire disclosure of which hereby is incorporated by reference in entirety.

In what follows, an "acid-derived component," indicates a polyester polymer constituent moiety that was originally an acid component before the synthesis of a polyester resin and an "alcohol-derived component" indicates a polyester polymer constituent moiety that was originally an alcoholic component before the synthesis of the polyester resin. The polyester often is named by the constituent monomers used to make the polymer, although the chemical entities incorporated into a polymer no longer are identical to the original reactant monomers.

Polycondensation catalysts may be utilized in forming either the crystalline or amorphous polyesters and include tetraalkyl titanates, dialkyltin oxides, such as, dibutyltin oxide, tetraalkyltins, such as, dibutyltin dilaurate, dialkyltin oxide hydroxides, such as, butyltin oxide hydroxide, aluminum alkoxides, alkyl zinc, dialkyl zinc, zinc oxide, stannous oxide or combinations thereof. Such catalysts may be utilized in amounts of, for example, from about 0.01 mole percent to about 5 mole percent based on the starting polyacid or polyester used to generate the polyester resin.

A, "crystalline polyester resin," is one that shows not a stepwise endothermic amount variation but a clear endothermic peak for phase change in differential scanning calorimetry (DSC). However, a polymer obtained by copolymerizing a crystalline polyester main chain and at least one other component is also called a crystalline polyester if the amount of the other component is 50% by weight or less. Acids having 6 to 10 carbon atoms may be desirable for obtaining suitable crystal melting point and charging properties. To improve the crystallinity, a straight chain carboxylic acid may be present in an amount of about 95% by mole or more of the acid component and, in embodiments, more than about 98% by mole of the acid component. Other acids are not particularly restricted, and examples thereof include conventionally known polyvalent carboxylic acids and polyhydric alcohols, for example, those described in "Polymer Data Handbook: Basic Edition" (Soc. Polymer Science, Japan Ed.: Baihukan). As the alcohol component, aliphatic polyalcohols having from about 6 to about 10 carbon atoms may be used to obtain desirable crystal melting points and charging, properties. To raise crystallinity, it may be useful to use the straight chain polyalcohols in an amount of about 95% by mole or more, about 98% by mole or more.

For forming a crystalline polyester, suitable polyols include aliphatic polyols with from about 2 to about 36 carbon atoms, such as, 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol and the like. The aliphatic polyol may be, for example, selected in an amount of from about 40 to about 60 mole percent, from about 42 to about 55 mole percent, from about 45 to about 53 mole percent (although amounts outside of those ranges can be used).

Examples of polyacids or polyesters, including, vinyl diacids or vinyl diesters, selected for the preparation of crystalline resins include oxalic acid, succinic acid, glutaric acid, adipic acid, suberic acid, azelaic acid, sebacic acid, fumaric acid, dimethyl fumarate, dimethyl itaconate, cis-1,4-diacetoxy-2-butene, diethyl fumarate, diethyl maleate, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof. The polyacid may be selected in an amount of from about 40 to about 60 mole percent, from about 42 to about 52 mole percent, from about 45 to about 50 mole percent.

Examples of crystalline resins include polyesters, polyamides, polyimides, polyolefins, polyethylene, polybutylene, polyisobutyrate, ethylene-propylene copolymers, ethylene-vinyl acetate copolymers, polypropylene, mixtures thereof, and the like. Specific crystalline resins may be polyester based, such as poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), poly(decylene-sebacate), poly(decylene-decanoate), poly(ethylene-decanoate), poly(ethylene dodecanoate), poly(nonylene-sebacate), poly(nonylene-decanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate) and so on. Examples of polyamides include poly(ethylene-adipamide), poly(propylene-adipamide), poly(butylenes-adipamide), poly(pentylene-adipamide), poly(hexylene-adipamide), poly(octylene-adipamide), poly(ethylene-succinimide), and poly(propylene-sebecamide). Examples of polyimides include poly(ethylene-adipimide), poly(propylene-adipimide), poly(butylene-adipimide), poly(pentylene-adipimide), poly(hexylene-adipimide), poly(octylene-adipimide), poly(ethylene-succinimide), poly(propylene-succinimide), and poly(butylene-succinimide).

The crystalline resin may be present, for example, in an amount of from about 5 to about 50 percent by weight of the toner components, from about 10 to about 35 percent by weight of the toner components. The crystalline resin can possess various melting points of, for example, from about 30° C. to about 120° C., from about 50° C. to about 90° C. The crystalline resin may have a number average molecular weight (Mn), as measured by gel permeation chromatography (GPC) of, for example, from about 1,000 to about 50,000, from about 2,000 to about 25,000, and a weight average molecular weight (Mw) of, for example, from about 2,000 to about 100,000, from about 3,000 to about 80,000, as determined by GPC. The molecular weight distribution (Mw/Mn) of the crystalline resin may be, for example, from about 2 to about 6, from about 3 to about 5.

Examples of polyacids or polyesters, including, vinyl diacids or vinyl diesters, utilized for the preparation of amorphous polyesters include polycarboxylic acids or polyesters, such as, terephthalic acid, phthalic acid, isophthalic acid, fumaric acid, dimethyl fumarate, dimethyl itaconate, cis, 1,4-diacetoxy-2-butene, diethyl fumarate, diethyl maleate, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecane diacid, dimethyl terephthalate, diethyl terephthalate, dimethylisophthalate, diethylisophthalate, dimethylphthalate phthalic anhydride, diethylphthalate, dimethylsuccinate, dimethylfumarate, dimethylmaleate, dimethylglutarate, dimethyladipate, dimethyl dodecylsuccinate, and combinations thereof. The polyacid or polyester may be present, for example, in an amount from about 40 to about 60 mole percent of the resin, from about 42 to about 52 mole percent of the resin, from about 45 to about 50 mole percent of the resin.

Examples of polyols which may be utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol heptanediol, dodecanediol, 1,4-cyclohexanedimethanol, 1,3-cyclohexanedimethanol, xylenedimethanol, cyclohexanediol, diethylene glycol, dipropylene glycol, dibutylene, and combinations thereof. The amount of polyol selected can vary, and may be present, for example, in an amount from about 40 to about 60 mole percent of the resin, from about 42 to about 55 mole percent of the resin, from about 45 to about 53 mole percent of the resin.

In embodiments, suitable amorphous resins include polyesters, polyamides, polyimides, polyolefins, polyethylene, polybutylene, polyisobutyrate, ethylene-propylene copolymers, ethylene-vinyl acetate copolymers, polypropylene, combinations thereof and the like.

In embodiments, an unsaturated amorphous polyester resin may be utilized as a latex resin. Examples of such resins include those disclosed in U.S. Pat. No. 6,063,827, the entire disclosure of which hereby is incorporated by reference in entirety. Exemplary unsaturated amorphous polyester resins include, but are not limited to, poly(1,2-propylene fumarate), poly(1,2-propylene maleate), poly(1,2-propylene itaconate) and combinations thereof.

The polyester resins may be synthesized from a combination of components selected from the above-mentioned monomer components, by using conventional known methods. Exemplary methods include the ester exchange method and the direct polycondensation method, which may be used singularly or in a combination thereof. The molar ratio (acid component/alcohol component) when the acid component and alcohol component are reacted, may vary depending on the reaction conditions. The molar ratio is usually about 1/1 in direct polycondensation. In the ester exchange method, a monomer, such as, ethylene glycol, neopentyl glycol or cyclohexanedimethanol, which may be distilled away under vacuum, may be used in excess.

b) Surfactant

Any suitable surfactant may be used for the preparation of, for example, the latex, pigment, wax or any other dispersion according to the present disclosure. Depending on the emulsion system, any desired nonionic or ionic surfactant, such as, anionic or cationic surfactant, may be contemplated.

Examples of suitable anionic surfactants include, but are not limited to, sodium dodecylsulfate (SDS), sodium dodecylbenzene sulfonate, sodium dodecylnaphthalenesulfate, dialkyl benzenealkyl sulfates and sulfonates abitic acid. NEOGEN R® and NEOGEN SC® available from Kao, Tayca Power®, available from Tayca Corp., DOWFAX®, available from Dow Chemical Co., and the like, as well as mixtures thereof.

Examples of suitable cationic surfactants include, but are not limited to, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$,$C_{15}$,$C_{17}$-trimethyl ammonium bromides, halide salts of quaternized polyoxyethylalkylamines, dodecylbenzyl triethyl ammonium chloride, MIRAPOL® and ALKAQUAT® (available from Alkaril Chemical Company), SANIZOL® (benzalkonium chloride, available from Kao Chemicals), and the like, as well as mixtures thereof.

Examples of suitable nonionic surfactants include, but are not limited to, polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol (available from sanofi as ANTAROX 890®, IGEPAL CA-210®, IGEPAL CA-520®, IGEPAL CA-720®, IGEPAL CO-890®, IGEPAL CO-720®, IGEPAL CO-290®, IGEPAL CA-210® and ANTAROX 897®) and the like, as well as mixtures thereof.

Surfactants may be employed in any desired or effective amount, for example, at least about 0.01% by dry or wet weight of reagents used to prepare the dispersion, at least about 0.1% by dry or wet weight of reagents used to prepare the dispersion; and no more than about 10% by dry or wet weight, no more than about 5% by dry or wet weight of the reagents used to prepare the dispersion, although the amount can be outside of those ranges.

c) Initiator

Any suitable initiator or mixture of initiators may be used in the latex process and the toner process. In embodiments, the initiator is selected from known free radical polymerization initiators such as one providing free radical species on heating to above about 30° C.

Although water soluble free radical initiators are used in emulsion polymerization reactions, other free radical initiators also can be used. Examples of suitable free radical initiators include, but are not limited to, peroxides, azo compounds, and the like; and mixtures thereof.

Free radical initiators include, but are not limited to, ammonium persulfate, hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, sodium persulfate, potassium persulfate, diisopropyl peroxycarbonate and the like.

Based on total weight of the monomers to be polymerized, the initiator may be present in an amount from about 0.1% to about 5% by weight or volume, from about 0.4% to about 4%, from about 0.5% to about 3% by weight or volume, although may be present in greater or lesser amounts.

d) Chain Transfer Agent

A chain transfer agent optionally may be used to control the polymerization degree of the latex, and thereby control the molecular weight and molecular weight distribution of the product latexes of the latex process and/or the toner process according to the present disclosure. As can be appreciated, a chain transfer agent can become part of the latex polymer.

A chain transfer agent can have a carbon-sulfur covalent bond. The carbon-sulfur covalent bond can have an absorption peak in a wavelength region from about 500 to about 800 $cm^{-1}$ in an infrared absorption spectrum. When the chain transfer agent is incorporated into the latex and the toner made from the latex, the absorption peak may be changed, for example, to a wavelength from about 400 to about 4,000 $cm^{-1}$.

Exemplary chain transfer agents include, but are not limited to, n-$C_{3-15}$ alkylmercaptans; branched alkylmercaptans; aromatic ring-containing mercaptans; and so on. The terms, "mercaptan," and, "thiol," may be used interchangeably to mean C—SH group.

Examples of such chain transfer agents also include, but are not limited to, dodecanethiol, butanethiol, isooctyl-3-mercaptopropionate, 2-methyl-5-t-butyl-thiophenol, carbon tetrachloride, carbon tetrabromide and the like.

Based on total weight of the monomers to be polymerized, the chain transfer agent may be present in an amount from about 0.1% to about 7%, from about 0.5% to about 6%, from about 1.0% to about 5%, although may be present in greater or lesser amounts.

e) Branching Agent

A branching agent optionally may be included to control the branching degree and structure of the target latex. Exemplary branching agents include, but are not limited to, decanediol diacrylate (ADOD), trimethylolpropane, pentaerythritol, trimellitic acid, pyromellitic acid, a carboxylic acid comprising three or more acid groups and mixtures thereof.

Based on total weight of the monomers to be polymerized, the branching agent may be present in an amount from about 0% to about 5%, from about 0.05% to about 4%, from about 0.1 to about 3%, although may be present in greater or lesser amounts.

f) Reaction

In the latex process and toner process of the disclosure, emulsification may be done by any suitable process, such as, mixing at elevated temperature. For example, the emulsion mixture may be mixed in a homogenizer set at about 200 to about 400 rpm and at a temperature of from about 20° C. to about 80° C. for a period of from about 1 min to about 20 min, although temperatures, speeds and times outside of those ranges can be used.

Any type of reactor may be used without restriction. The reactor can include means for stirring the compositions therein, such as, an impeller. A reactor can include at least one impeller. For forming the latex and/or toner, the reactor can be operated throughout the process such that the impellers can operate at an effective mixing rate of about 10 to about 1,000 rpm. The reactor cart be a continuous reactor of lower reaction volume occurring under flow of reactants in and product out through a directional flow path, such as, a conduit or a tube. Batch and continuous devices and methods can be combined in a process for making toner.

Following completion of the monomer addition, the latex may be permitted to stabilize by maintaining the conditions for a period of time, for example for about 10 to about 300 min. before cooling. Optionally, the latex formed by the above process may be isolated by standard methods known in the art, for example, coagulation, dissolution or precipitation, filtering, washing, drying or the like.

The latex of the present disclosure comprising a methacrylate of interest may be selected for emulsion-aggregation-coalescence processes for forming toners and developers by known methods.

The latex of the present disclosure may be melt blended or otherwise mixed with various toner ingredients, such as, an optional wax dispersion, an optional colorant, an optional coagulant, an optional silica, an optional charge enhancing additive or charge control additive, an optional surfactant, an optional emulsifier, an optional flow additive and the like. Optionally, the latex (e.g. around 40% solids) may be diluted to the desired solids loading (e.g. about 12 to about 15% by weight solids), before formulated in a toner composition.

Based on the total toner weight, the latex may be present in an amount from about 50% to about 98%, from about 60% to about 97%, from about 70% to about 95%, although may be present in greater or lesser amounts. Methods of producing such latex resins may be carried out as described in U.S. Pat. No. 7,524,602, the entire disclosure of which herein is incorporated by reference in entirety.

g) Colorants

Various known suitable colorants, such as dyes, pigments, mixtures of dyes, mixtures of pigments, mixtures of dyes and pigments and the like may be included in the toner. The colorant may be included in the toner in an amount of, for example, 0 to about 35% by weight of the toner, from about 1 to about 15% percent of the toner, from about 3 to about 10% by weight of the toner, although amounts outside those ranges may be utilized.

As examples of suitable colorants, mention may be made of carbon black, like, REGAL 330®; magnetites, such as, Mobay magnetites MO8029™ and MO8060™; Columbian magnetites; MAPICO BLACKS™, surface-treated magnetites; Pfizer magnetites CB4799™, CB5300™, CB5600™ and MCX6369™; Bayer magnetites, BAYFERROX 8600™ and 8610™; Northern Pigments magnetites, NP-604™ and NP-608™; Magnox magnetites TMB-100™ or TMB-104™, and the like. As colored pigments, there can be selected cyan, magenta, yellow, red, green, brown, blue or mixtures thereof. Generally, cyan, magenta or yellow pigments or dyes, or mixtures thereof, are used. The pigment or pigments can be water-based pigment dispersions.

Specific examples of pigments include SUNSPERSE 6000, FLEXIVERSE and AQUATONE water-based pigment dispersions from SUN Chemicals, HELIOGEN BLUE L6900™, D6840™, D7080™, D7020™, PYLAM OIL BLUE™, PYLAM OIL YELLOW™, PIGMENT BLUE I™ available from Paul Uhlich & Company, Inc., PIGMENT VIOLET I™, PIGMENT RED 48™, LEMON CHROME YELLOW DCC 1026™, E.D. TOLUIDINE RED™ and BON RED C™ available from Dominion Color Corp., Ltd., Toronto, Calif., NOVAPERM YELLOW FGL™, HOSTAPERM PINK E™ from sanofi, CINQUASIA MAGENTA™ available from E.I. DuPont de Nemours & Co. and the like. Colorants that can be selected are black, cyan, magenta, yellow and mixtures thereof. Examples of magenta colorants are 2,9-dimethyl-substituted quinacridone and anthraquinone dye identified in the Color Index (CI) as CI 60710, CI Dispersed Red 15, diazo dye identified in the Color Index as CI 26050, CI Solvent Red 19 and the like. Illustrative examples of cyans include copper tetra(octadecyl sulfonamido) phthalocyanine, x-copper phthalocyanine pigment listed in the Color index as CI 74160, CI Pigment Blue, Pigment Blue 15:3, Anthrathrene Blue, identified in the Color index as CI 69510, Special Blue X-2137 and the like. Examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide and Permanent Yellow FGL. Colored magnetites, such as, mixtures of MAPICO BLACK™, and cyan components also may be selected as colorants. Other known colorants can be selected, such as, Levanyl Black A-SF (Miles, Bayer) and Sunsperse Carbon Black LHD 9303 (Sun Chemicals), and colored dyes, such as, Neopen Blue (BASF), Sudan Blue OS (BASF), PV Fast Blue B2G01 (sanofi), Sunsperse Blue BHD 6000 (Sun Chemicals), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Winch), Paliogen Yellow 152, 1560 (BASF), Lithol Fast Yellow 0991K (BASF), Paliotol Yellow 1840 (BASF), Neopen Yellow (BASF), Novoperm Yellow FG 1 (sanofi), Permanent Yellow YE 0305 (Paul Uhlich), Lumogen Yellow D0790 (BASF), Sunsperse Yellow YHD 6001 (Sun Chemicals), Suco-Gelb L1250 (BASF), Suco-Yellow D1355 (BASF), Hostaperm Pink E (sanofi), Fanal Pink D4830 (BASF), Cinquasia Magenta (DuPont), Lithol Scarlet D3700 (BASF), Toluidine Red (Aldrich). Scarlet for Thermoplast NSD PS PA (Ugine Kuhlmann, CA), E.D. Toluidine Red (Aldrich), Lithol Rubine Toner (Paul Uhlich), Lithol Scarlet 4440 (BASF), Bon Red C (Dominion Color Co.), Royal Brilliant Red RD-8192 (Paul Uhlich), Oracet Pink RE (Ciba-Geigy), Paliogen Red 3871K (BASF), Paliogen Red 3340 (BASF), Litho, Fast Scarlet L4300 (BASF), combinations of the foregoing and the like.

h) Wax

Toners of the present disclosure also may contain a wax, which can be either a simile type of wax or a mixture of two or more different waxes. The wax may be present in an amount of, for example, from about 1 wt % to about 25 wt % of the toner particles, from about 5 wt % to about 20 wt % of the toner particles. The melting point of a wax can be at least about 30° C., at least about 40° C., at least about 50° C. Waxes that may be selected include waxes having, for example, a weight average molecular weight of from about 500 to about 20,000, from about 1,000 to about 10,000.

Waxes that may be used include, for example, polyolefins, such as, polyethylene, polypropylene and polybutene waxes, such as, those commercially available from Allied. Chemical and Petrolite Corporation, for example POLYWAX™ polyethylene waxes from Baker Petrolite, wax emulsions available from Michaelman, Inc. and the Daniels Products Company, EPOLENE N-15™ commercially available from Eastman Chemical Products, Inc., and VISCOL 550-P™, a low weight average molecular weight polypropylene available from Sanyo Kasei K. K.; plant-based waxes, such as, carnauba wax, rice wax, candelilla wax, sumacs wax and jojoba oil; animal-based waxes, such as, beeswax; mineral-based waxes and petroleum-based waxes, such as, montan wax, ozokerite, ceresin, paraffin wax, microcrystalline wax and Fischer-Tropsch wax; ester waxes obtained from higher fatty acid and higher alcohol, such as, stearyl stearate and behenyl behenate; ester waxes obtained from higher fatty acid and monovalent or multivalent lower alcohol, such as, butyl stearate, propyl oleate, glyceride monostearate, glyceride distearate, pentaerythritol tetra behenate; ester waxes obtained from higher limy acid and multivalent alcohol multimers, such as, diethyleneglycol monostearate, dipropyleneglycol distearate, diglyceryl distearate and triglyceryl tetrastearate sorbitan higher fatty acid ester waxes, such as, sorbitan monostearate, and cholesterol higher fatty acid ester waxes, such as, cholesteryl stearate. Examples of functionalized waxes that may be used include, for example, amines, amides, for example, AQUA SUPERSLIP 6550™ and SUPERSLIP 6530™ available from Micro Powder Inc., fluorinated waxes, for example, POLYFLUO 190™, POLYFLUO 200™, POLYSILK 19™ and POLYSILK 14™ available from Micro Powder Inc., mixed fluorinated, amide waxes, for example, MICROSPERSION 19™ available from Micro Powder Inc., imides, esters, quaternary amines, carboxylic acids or acrylic polymer emulsion, for example JONCRYL 74™, 89™, 130™, 537™ and 538™, all available from SC Johnson Wax, and chlorinated polypropylenes and polyethylenes available from Allied Chemical and Petrolite Corporation and SC Johnson wax. Mixtures and combinations of the foregoing waxes also may be used in embodiments.

Toner Preparation

The toner particles may be prepared by any method within the purview of one skilled in the art. Although embodiments are described below with respect to emulsion-aggregation (EA) processes, any suitable method of preparing toner particles may be used, including chemical processes, such as suspension and encapsulation processes disclosed in U.S. Pat. Nos. 5,290,654 and 5,302,486, the entire disclosure of each of which hereby is incorporated by reference in entirety. In embodiments, toner compositions and toner particles may be prepared by aggregation and coalescence processes in which smaller-sized resin particles are aggregated to the appropriate toner particle size and then coalesced to achieve the final toner particle shape and morphology.

In an EA process, a mixture of an optional wax and any other desired or required additives, and emulsions including the resins, for example, a polyester, a vinyl polymer, a styrene polymer and so on, including a resin of interest described above, optionally with surfactants, as described above, are aggregated and then optionally coalesced, see, for example, U.S. Pat. No. 6,120,967, the entire disclosure of which hereby is incorporated by reference in entirety. A mixture may be prepared by adding an optional wax, an optional colorant or other materials, which optionally also may be in a dispersion(s) including a surfactant, to the emulsion, which may be a mixture of two or more emulsions containing the resin. The pH of the resulting mixture may be adjusted by an acid, such as, for example, acetic acid, nitric acid or the like. In embodiments, the pH of the mixture may be adjusted to from about 2 to about 5. Additionally, in embodiments, the mixture may be homogenized by mixing at about 600 to about 4,000 revolutions per minute (rpm). Homogenization may be accomplished by any suitable means, including, for example, with an IKA ULTRA TURRAX T50 probe homogenizer.

Following preparation of the above mixture, an aggregating agent (or coagulant) may be added to the mixture. Suitable aggregating agents include, for example, aqueous solutions of a divalent cation or a multivalent cation material. The aggregating agent may be, for example, polyaluminum halides, such as, polyaluminum chloride (PAC), or the corresponding bromide, fluoride or iodide, polyaluminum silicates, such as, polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate and combinations thereof.

In embodiments, the aggregating agent may be added to the mixture at a temperature that is below the glass transition temperature ($T_g$) of the resin. The aggregating agent may be added to the mixture in an amount of, for example, from about 0.1 parts per hundred (pph) to about 1 pph, from about 0.25 pph to about 0.75 pph.

To control aggregation and coalescence of the particles, the aggregating agent may be metered into the mixture over time. For example, the agent may be metered into the mixture over a period of from about 5 to about 240 min, from about 30 to about 200 min. Addition of the agent also may be done while the mixture is maintained under stirred conditions, in embodiments, about 50 rpm to about 1,000 rpm, from about 100 rpm to about 500 rpm, and at a temperature that is below the $T_g$ of the resin.

The aggregation thus may proceed by maintaining the elevated temperature, or slowly raising the temperature to, for example, from about 40° C. to about 100° C., and holding the mixture at that temperature for a time from about 0.5 hr to about 6 hr, from about 1 hr to about 5 hr, while maintaining stirring, to provide the aggregated particles. In embodiments, the particle size may be about 4 to about 8 μm, from about 4.5 to about 7.5 μm, from about 5 to about 7 μm.

The particles may be permitted to aggregate until a predetermined desired particle size is obtained. Particle size can be monitored as known in the art, for example, with a COULTER COUNTER, for average particle size.

Once the desired final size of the toner particles is achieved, the pH of the mixture may be adjusted with a base to a value of from about 6 to about 10, from about 5 to about 8. The adjustment of the pH may be utilized to freeze, that is, to stop, toner growth. The base utilized to stop toner growth may include any suitable base, such as, for example, alkali metal hydroxides, such as, for example, sodium hydroxide, potassium hydroxide, ammonium hydroxide, combinations thereof and the like. In embodiments, a chelator, such as, ethylene diamine tetraacetic acid (EDTA) may be added to help adjust the pH to the desired values noted above.

a) Shell Resin

In embodiments, a shell may be applied to the formed aggregated toner particles. Any resin described above as suitable for the core resin may be utilized as the shell resin, such as, a bio-based resin comprising an acrylate or methacrylate of interest. The shell resin may be applied to the aggregated particles by any method within the purview of those skilled in the art. In embodiments, the shell resin may be in an emulsion including any surfactant described herein. The aggregated particles described above may be combined with said emulsion so that the resin forms a shell over the firmed aggregates. In embodiments, an amorphous polyester may be utilized to form a shell over the aggregates to form toner particles having a core-shell configuration.

Toner particles can have a diameter of from about 3 to about 8 μm, from about 4 to about 7 μm, and the optional shell component may comprise about 5 to about 50% by weight of the toner particles, although amounts can be outside of that range. A thicker shell may be desirable to provide desirable charging characteristics due to the higher surface area of the toner particle. Thus, the shell resin may be present in an amount from about 30% to about 70% by weight of the toner particles, from about 35% to about 65% by weight of the toner particles, from about 40% to about 60% by weight of the toner particles. In embodiments, the shell has a higher $T_g$ than the aggregated toner particles. The shell can carry one or more toner components, such as, a charge control agent, a colorant, such as, a carbon black, a silica and so on.

In embodiments, a photoinitiator may be included in the resin mixture for forming the shell. Thus, a photoinitiator may be in the core, the shell or both. The photoinitiator may be present in an amount of from about 1% to about 5% by weight of the toner particles, in embodiments, from about 2% to about 4% by weight of the toner particles. The shell resin can contain a branching agent.

b) Coalescence

Following aggregation to the desired particle size, with the optional formation of a shell as described above, the particles then may be coalesced to the desired final shape, the coalescence being achieved by, for example, heating the mixture to a temperature of from about 55° C. to about 100° C., from about 65° C. to about 75° C., which may be below the melting point of any crystalline resin present to prevent plasticization. Higher or lower temperatures may be used, it being understood that the temperature is a function of the resins used. Coalescence may proceed over a period of from about 0.1 to about 9 hr, from about 0.5 to about 4 hr.

After coalescence, the mixture may be cooled to RT, such as from about 20° C. to about 25° C. The codling may be rapid or slow. A suitable cooling method may include introducing cold water to a jacket around the reactor. After cooling, the toner particles optionally may be washed with water and then dried. Drying may be accomplished by any suitable method, for example, freeze drying.

c) Additives

Toner particles also may contain other optional additives, as desired or required. For example, the toner may include any known charge additives in amounts of from about 0.1 to about 10 wt %, from about 0.5 to about 7 wt % of the toner. Examples of such charge additives include alkyl pyridinium halides, bisulfates, the charge control additives of U.S. Pat. Nos. 3,944,493, 4,007,293, 4,079,014, 4,394,430 and 4,560,635, the entire disclosure of each of which hereby is incorporated by reference in entirety, negative charge enhancing additives like aluminum complexes, and the like.

Surface additives can be added to the toner compositions after washing or drying. Examples of such surface additives include, for example, metal salts, metal salts of fatty acids, colloidal silicas, metal oxides, strontium titanates, mixtures thereof and the like. Surface additives may be present in an amount of from about 0.1 to about 10 wt %, from about 0.5 to about 7 wt % of the toner. Examples of such additives include those disclosed to U.S. Pat. Nos. 3,590,000, 3,720,617, 3,655,374 and 3,983,045, the entire disclosure of each of which hereby is incorporated by reference in entirety. Other additives include zinc stearate and AEROSIL R972® (Degussa). The coated silicas of U.S. Pat. Nos. 6,190,815 and 6,004,714, the entire disclosure of each of which hereby is incorporated by reference in entirety, also can be present in an amount of from about 0.05 to about 5%, from about 0.1 to about 2% of the toner, which additives can be added during aggregation or blended into the formed toiler product.

The characteristics of the toner particles may be determined by any suitable technique and apparatus. Volume average particle diameter $D_{50v}$, geometric standard deviation (GSD) volume ($GSD_v$) and number GSD ($GSD_n$) may be measured by means of an instrument, such as, a Beckman Coulter MULTISIZER 3, operated as recommended by the manufacturer.

Utilizing the methods of the present disclosure, desirable gloss levels may be obtained. Thus, for example, the gloss level of a toner may have a gloss, as measured with a Gardner device of from about 20 gloss units (gu) to about 100 gu, from about 50 gu to about 95 gu, from about 60 gu to about 90 gu. The gloss of a toner may be influenced by the amount of retained metal ion, such as, $Al^{3+}$, in the particle. In embodiments, the amount of retained metal ion, for example, $Al^{3+}$, in toner particles of the present disclosure may be from about 200 ppm (parts per million) for high gloss to about 2000 ppm for lower gloss.

In embodiments, toners of the present disclosure may be utilized as ultralow melt (ULM) toners.

In embodiments, the dry toner particles, exclusive of external surface additives, may have the following characteristics: (1) circularity of from about 0.9 to about 1 (measured with, for example, a Sysmex 3000), from about 0.95 to about 0.99, from about 0.96 to about 0.98; (2) Tg of from about 45° C. to about 60° C., from about 48° C. to about 55° C. author (3) melt flow index (MFI) in g/10 min (5 kg/130° C.) of from about 70 to about 175.

Toners may possess favorable charging characteristics when exposed to extreme RH conditions. The low humidity zone (C zone) may be about 12° C./15% RH, while the high humidity zone (A zone) may be about 28° C./85% RH. Toners of the disclosure may possess a parent toner charge per mass ratio (q/m) of from about −5 μC/g to about −80 μC/g, from about −10 μC/g to about −70 μC/g, and a final toner charging after surface additive blending of from −15 μC/g to about −60 μC/g, from about −20 μC/g to about −55 μC/g.

Thus, in embodiments, toner A zone charge may be from about −15 to about −60 μC/g, from about −20 to about −55 μC/g, while C zone charge may be from about −1.5 to about −60 μC/g, from about −20 to about −55 μC/g. The ratio of A zone charge to C zone charge, sometimes referred to herein as the RH ratio or RH sensitivity, may be from about 0.4 to about 1.0, from about 0.6 to about 0.8.

The following Examples are submitted to illustrate embodiments of the disclosure. The Examples are intended to be illustrative only and are not intended to limit the scope of the disclosure. Also, parts and percentages are by weight unless otherwise indicated.

EXAMPLES

Example 1

Preparation of Isosorbide Diacrylate

To a 1 L round-bottomed flask equipped with an overhead stirrer were added isosorbide (25 g, 171 mmol) followed by tetrahydrofuran (THF) (500 ml). The mixture was stirred at RT to yield a clear solution. Then, triethylamine (59.6 ml, 428 mmol) was added and stirred for 10 min at 0° C. Next, acryloyl chloride (34.7 ml, 428 mmol) was charged into a 60 ml, dropping funnel and added dropwise to the cooled solution. White precipitate formed as the chloride was added. The reaction was warmed slowly to RT and allowed to stir overnight. The next day, the solvent was evaporated in vacuo and the residue was extracted with a 200 mL 5% HCl wash, and 2×200 mL ethyl acetate washes. The ethyl acetate washes were combined, dried with $MgSO_4$ and solvent was removed in vacuo to furnish 11.81 g of isosorbide diacrylate as a golden-colored, pungent, viscous oil (46.5 mmol, 27.2% yield), see, for example, U.S. Publ. No. 2012/0092426, the entire disclosure of which herein is incorporated by reference in entirety.

Example 2

Preparation of Isosorbide Dimethacrylate

To a 1 L round-bottomed flask equipped with an overhead stirrer is added isosorbide (25 g, 171 mmol) followed by tetrahydrofuran (THF) (500 ml). The mixture is stirred at RT to yield a clear solution. Then, triethylamine (59.6 ml, 428 mmol) is added and stirred for 10 min at 0° C. Next, methacryloyl chloride (39.8 ml, 428 mmol) is charged into a 60 mL dropping funnel and added dropwise to the cooled solution. White precipitate is formed as the chloride was added. The reaction is warmed slowly to RT and allowed to stir overnight. The next day, the solvent is evaporated in vacuo and the residue is extracted with a 200 mL 5% HCl wash, and 2×200 mL ethyl acetate washes. The ethyl acetate washes were combined, dried with $MgSO_4$ and solvent was removed in vacuo to furnish 11.81 g of isosorbide diacrylate as a golden-colored, pungent, viscous oil (46.5 mmol, 27.2% yield), see, for example, U.S. Pat. No. 8,613,507, the entire disclosure of which herein is incorporated by reference in entirety.

Example 3

Preparation of Isosorbide Acrylate or Methacrylate

To a 1 L round-bottomed flask equipped with an overhead stirrer are added isosorbide (25 g, 171 mmol) followed by THF (500 ml). The mixture is stirred at RT to yield a clear solution. Then, triethylamine (23.8 mL 171 mmol) is added and stirred for 10 min at 0° C. Next, acryloyl chloride (14.2 ml, 180 mmol) or methacryloyl chloride (16.3 ml, 180 mmol) is charged into a 60 mL dropping funnel and added dropwise to the cooled solution. White precipitate forms as the chloride is added. The reaction is warmed to RT and stirred overnight. The next day, the solvent is evaporated in vacuo and the residue is extracted with a 200 mL 5% HCl wash, and 2×200 mL ethyl acetate washes. The ethyl acetate washes are combined, dried with $MgSO_4$ and solvent is removed in vacuo to furnish the isosorbide acrylate or methacrylate comprised of about 1:1 ratio of the endo/exo isomers, as measured by NMR (nuclear magnetic resonance).

Example 4

Preparation of Isosorbide Acrylate or Methacrylate Resin

Polymeric resin derived from the isosorbide acrylate, methacrylate, diacrylate or dimethacrylate of Example 1, 2 or 3 is prepared by emulsion, mini-emulsion, suspension or bulk polymerization and with the addition of co-monomers, such as, styrene, methacrylic acid and/or dimethylaminoethyl methacrylate to control the Tg and hydrophobicity of the polymeric resin. The diacrylate monomer can be used optionally to create cross-linking or branching. The thus formed polymeric resin prepared may not be in the form of a latex, but is optionally further treated to form a latex by solvent phase inversion emulsification or solvent flash emulsification, or by a solvent-less emulsification.

Example 5

Preparation of a Carrier Comprising Isosorbide Acrylate Resin

To a 250 ml polyethylene (PE) bottle are added 120 grams of 35 μm ferrite core (PowderTech), 0.912 grams of a dried isosorbide acrylate polymer latex of Example 4 and 5 wt % CABOT VULCAN XC72 carbon black by weight of coating. The bottle then is sealed and loaded into a C-zone TURBULA mixer which is run for 45 min to disperse the powder onto the carrier core particles. Next, a HAAKE mixer is set at 200° C. (all zones), 30 minute batch time and 30 RPM with high shear rotors. After the HAAKE reaches temperature, the mixer rotation is started and the blend is transferred from the TURBULA into the HAAKE mixer. After 45 minutes, the carrier is discharged from the mixer and sieved through a 45 μm screen.

The carrier process can be scaled by mixing the latex and carrier core in a high intensity HENSCHEL mixer and then fused to the core in a rotary kiln.

Commercially available carrier coatings can have a C/O ratio of about 2.5 for PMMA-based coating compositions. An isosorbide-based acrylate would have a C/O ratio of 1.8, or with as trimethyl group termination on the other hydroxyl group, a C/O ratio of 2.6. An isosorbide-based methacrylate would have a C/O ratio of 2, or 2.8 with the trimethyl group termination. By combining an isosorbide acrylate, methacrylate, diacrylate or dimethacrylate monomer during polymerization with a comonomer with a higher C/O ratio, the overall C/O ratio can be increased. For example, a 50:50 mixture of trimethyl isosorbide methacrylate and CHMA would have a C/O ratio of 3.9.

In that way, the present carrier composition can maintain a higher C/O ratio of at least 2.5 or greater for appropriate RH sensitivity. The present carrier composition comprising an isosorbide (di)(meth)acrylate resin comprises a comparable RH sensitivity as compared to a carrier composition comprising a conventional resin (e.g. no bio-based monomers), especially those carrier coatings comprising a PMMA resin.

In embodiments, the present carrier composition comprising an isosorbide (di)(meth)acrylate resin as a carrier coating comprises a C/O ratio greater than 2.5. In embodiments, the C/O ratio is between about 2.5 and about 5. In embodiments, the C/O ratio is greater than about 2.5 but less than about 5. In embodiments, the C/O ratio is from about 2.75 to about 4.5.

Example 6

Preparation of Methacrylated Rosin

To a 2 liter reactor equipped with a mechanical stirrer are added 644 grams of hydrogenated rosin (FORAL AX, Pinova, Inc. (Brunswick, Ga.), 142 grams of glycidyl methacrylate, 1 gram of tetraethyl ammonium bromide and 0.2 grams of hydroquinone, and the mixture is heated to 170° C. over a 6 hour period. Methacrylated rosin according to the following synthetic scheme is produced, where R is a methyl group.

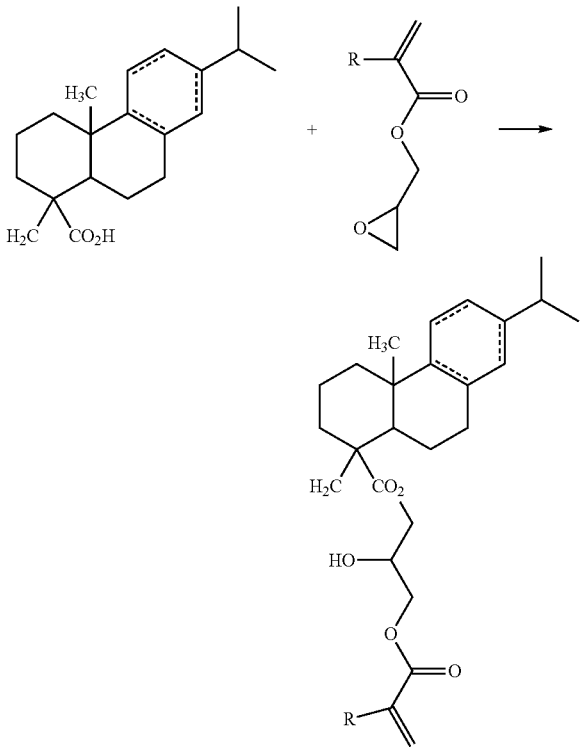

Example 7

Preparation of Methacrylated Rosin Resin

Polymeric resin derived from the methacrylated rosin of Example 6 is prepared by emulsion, suspension or bulk polymerization with comonomers, such as, styrene, methacrylic acid and/or dimethylaminoethyl methacrylate to control the Tg and hydrophobicity of the polymeric resin. The thus formed polymeric resin prepared may not in the form of a latex, but is optionally further treated to form a latex by solvent phase inversion emulsification or solvent flash emulsification, or by a solvent-less emulsification.

Example 8

Preparation of a Carrier Comprising a Rosin Methacrylate Resin

To a 250 ml PE bottle are added 120 grams of 35 μm ferrite core (PowderTech), 0.912 grams of the methacrylated rosin dried latex of Example 7 and 5 wt % CABOT VULCAN XC72 carbon black by weight of coating. The bottle is sealed and loaded into a C-zone TURBULA mixer. The TURBULA mixer is run for 45 minutes to disperse the powders onto the carrier core particles. Next, the HAAKE mixer is set as described in Example 5 after which the carrier is passed through a 45 μm screen.

A rosin acid-based methacrylate would have a C/O ratio of 6.75 and therefore provides a resin with low RH sensitivity. The present carrier composition comprising a rosin-(meth)acrylate resin as a carrier coating comprises an improved RH sensitivity as compared to a carrier composition comprising a conventional resin (e.g. no bio-based monomers), especially those carrier coatings comprising PMMA resin.

In embodiments, the present carrier composition comprising a rosin-acrylate resin as a carrier coating comprises a C/O ratio greater than 5. In certain embodiments, the C/O ratio is between about 5 and about 8. In embodiments, the C/O ratio is greater than about 5 but less than about 8 in embodiments, the C/O ratio is at least about 5.5, at least about 6.5, at least about 7.

Example 9

Toner

About 290 grams or the latex of Example 7 comprising rosin methacrylate and having a solids loading of about 40 weight % and 60 grams of paraffin wax having a solids loading of 30 weight %, are added to 610 grams of deionized water (DIW) in a vessel and stirred using an IKA homogenizer operating at about 4,000 rpm. Thereafter, 64 grams of cyan pigment dispersion having a solids loading of 17 weight % are added to the reactor, followed by drop-wise addition of 36 g of a flocculent mixture containing 3.6 grams polyaluminum chloride mixture and 32.4 g 0.02 molar nitric acid solution. As the flocculent mixture is added drop-wise, the homogenizer speed is increased to 5,200 rpm and homogenized for an additional 5 min. Thereafter, the mixture is heated at 1° C. per minute to a temperature of 48 to 55° C. and held there until the average particle diameter of 5 μm as measured with a COULTER COUNTER, is obtained. During a heat up period, the stirrer is run at about 200 to 300 rpm. Then, 135 grams of the rosin methacrylate latex having a solids loading of 40 wt % are added to the reactor mixture and allowed to aggregate for an additional period at 48 to 55° C. resulting in a volume average particle diameter of about 5.7 μm. The pH of the reactor mixture is adjusted to higher pH with sodium hydroxide solution followed by addition of 4.8 grams of EDTA having a solids loading of 40 weight %. Thereafter, the reactor mixture is heated at 1° C. per minute to a temperature of about 93 to 97° C. Then, the reactor mixture is stilted gently at 93 to 97° C. to enable the particles to coalesce and to spheroidize for about 2 to 4 hours to obtain a circularity of about 0.97 to 0.98 (as measured by a Sysmex 3000). The reactor mixture is allowed to cool to RT at a rate of 1° C. per minute. The mixture is cooled to 60-65° C., base adjusted to pH 8-9 and further cooled. Once cooled to RT, the product is sieved, washed and dried to produce dry toner particles.

Example 10

Toner

About 290 grams of the latex of Example 4 comprising isosorbide methacrylate and having a solids loading of about 40 weight % and 60 grams of paraffin wax having a solids loading of 30 weight % are added to 610 grams of DIW in a vessel and stirred using an IKA homogenizer operating at about 4,000 rpm. Thereafter, 64 grams of cyan pigment dispersion having a solids loading of 17 weight % are added to the reactor, followed by drop-wise addition of 36 grams of a flocculent mixture containing 3.6 grams polyaluminum chloride mixture and 32.4 grams 0.02 M nitric acid solution. As the flocculent mixture is added drop-wise, the homogenizer speed is increased to 5,200 rpm and homogenized for an additional 5 minutes. Thereafter, the mixture is heated at 1° C. per minute to a temperature of 48 to 55° C. and held there until the average particle diameter of 5 μm as measured with a COULTER COUNTER is obtained. During a heat up period, the stirrer is run at about 200 to 300 rpm. Then, 135 grams of the isosorbide methacrylate comprised latex having a solids loading of 40 weight % are added to the reactor mixture and allowed to aggregate for an additional period at 48 to 55° C. resulting in a volume average article diameter of about 5.7 μm. The pH of the reactor mixture is adjusted to higher pH with sodium hydroxide solution followed by addition of 4.8 grams of EDTA having a solids loading of 40 weight %. Thereafter, the reactor mixture is heated at 1° C. per minute to a temperature of about 93 to 97° C. Then, the reactor mixture is stirred gently at 93 to 97° C. to enable the particles to coalesce and to spheroidize for about 2 to 4 hours to obtain a circularity of about 0.97 to 0.98 (as measured by a Sysmex 3000). The reactor mixture is allowed to cool to RT at a rate of 1° C. per minute. The mixture is cooled to 60-65° C., base adjusted to pH 8-9 and further cooled. Once cooled to RT, the product is sieved, washed, and dried to produce dry toner particles.

It will be appreciated that several of the above-disclosed and other features and functions, or alternatives thereof, may be desirably combined into many other different systems or applications. Also various presently unforeseen or Unanticipated alternatives, modifications, variations or improvements therein may be subsequently made by those skilled in the art, which are also intended to be encompassed by the following claims. Unless specifically recited in a claim, steps or components of claims should not be implied or imported from the specification or any other claims as to any particular order, number, position, size, shape, angle, color or material.

The entire disclosure of all references cited herein each is incorporated herein by reference in entirety.

We claim:

1. A carrier composition comprising a core and a coating thereon, wherein said coating comprises a resin comprising a bio-based acrylate or methacrylate monomer, and optionally a styrene, acrylic or methacrylic monomer, wherein said bio-based acrylate or methacrylate monomer comprises an isosorbide moiety.

2. The carrier composition of claim 1, wherein the coating further comprises a conductive material.

3. The carrier composition of claim 1, wherein the coating further comprises a colorant.

4. The carrier composition of claim 1, wherein the carrier coating resin comprises a C/O ratio greater than 2.5.

* * * * *